US005545067A

United States Patent [19]

Garofalo

[11] Patent Number: 5,545,067

[45] Date of Patent: Aug. 13, 1996

[54] SWIMMING FIN WITH BUCKLE FOR FASTENING THE HEEL STRAP

[75] Inventor: Giovanni Garofalo, Rapallo, Italy

[73] Assignee: HTM Sport S.p.A, Italy

[21] Appl. No.: 438,920

[22] Filed: May 10, 1995

[30] Foreign Application Priority Data

Jun. 16, 1994 [IT] Italy ..... GE94A000079

[51] Int. Cl.[6] ..... A63B 31/11

[52] U.S. Cl. ..... 441/64

[58] Field of Search ..... 441/61–64; 280/611, 280/11.3, 11.31, 11.33, 616, 623, 632

[56] References Cited

U.S. PATENT DOCUMENTS

| | | | |
|---|---|---|---|
| 2,779,077 | 1/1957 | Kline | 441/64 |
| 3,940,815 | 3/1976 | Hill | 441/64 |
| 4,795,385 | 1/1989 | Matsuoka | 441/64 |
| 5,083,954 | 1/1992 | Jacobs | 441/64 |

*Primary Examiner*—Jesus D. Sotelo
*Attorney, Agent, or Firm*—Larson and Taylor

[57] ABSTRACT

Fin with buckle for securing the heel strap to the open-shoe type fin, in which said buckle comprises: a base piece on the side of the fin next to the socket for the foot; an intermediate lever hinged at one end in said base piece; and an end piece bearing at one end the means for connection to said strap, while its other end is hinged at a point on said intermediate lever between the end hinged to the base piece and the free end.

9 Claims, 3 Drawing Sheets

SWIMMING FIN WITH BUCKLE FOR FASTENING THE HEEL STRAP

BACKGROUND AND SUMMARY OF THE INVENTION

The present invention relates to swimming fins, especially the open-shoe type of swimming fin with a heel strap secured to both sides of the foot socket, and relates more particularly to a buckle for adjustably fastening the strap to the fin.

Many combinations for swimming fins of this kind are known in the prior art.

U.S. Pat. No. 4,795,385 discloses a swimming fin that comprises a heel strap attached to the opposite sides of the foot socket by means of a buckle consisting of two parts that fit one inside the other with a snap action.

The fin having a buckle fitted with such a closure device does, however, have many disadvantages. In the first place, closure systems such as those disclosed in the U.S. patent cited above require that the strap tension be adjusted each time the fin is put on because in order to fit the two parts of the buckle together it is necessary to slacken the length of strap. Moreover, closing, unlike releasing, always requires the use of both hands. There are also problems relating to carrying the fins once the buckle has been released: in order that the strap can be used as a hand grip for carrying the fin, it has to be refastened. This feature also creates a risk when unfastening the buckle before, for example, climbing into a boat, because the fin may slip out of the hand and be lost. Another problem arises if the underwater user of the fin wears gloves, which are usually quite thick, as these make it very difficult to fasten and unfasten the buckle whether in or out of the water.

The object of the present invention is therefore a fin with a heel strap secured at both sides of the foot socket, this strap being attached to at least one side of the socket by means that will overcome the disadvantages of known systems of the prior art.

The subject of the invention is therefore a fin with a buckle for securing the heel strap to the open-shoe type fin, in which said buckle comprises: a base piece connected by a pivot to the side of the fin next to the socket; a lever hinged at one end in said base piece; and an arm bearing at one end the means for connection to said strap, while its other end is hinged at a point on said lever between the end hinged to the base piece and the free end.

Advantageously, said means for the connection of said strap allow for its length to be adjusted.

In addition, the lever engages in a restrained closure with said base piece.

BRIEF DESCRIPTION OF THE DRAWINGS

Further advantages and characteristics will be clear from the following detailed description of an embodiment of the buckle according to the invention made,for illustrative purposes and without implying any restriction, with reference to the attached drawings, in which.

DESCRIPTION OF THE PREFERRED EMBODIMENT OF THE INVENTION

Figure 1:
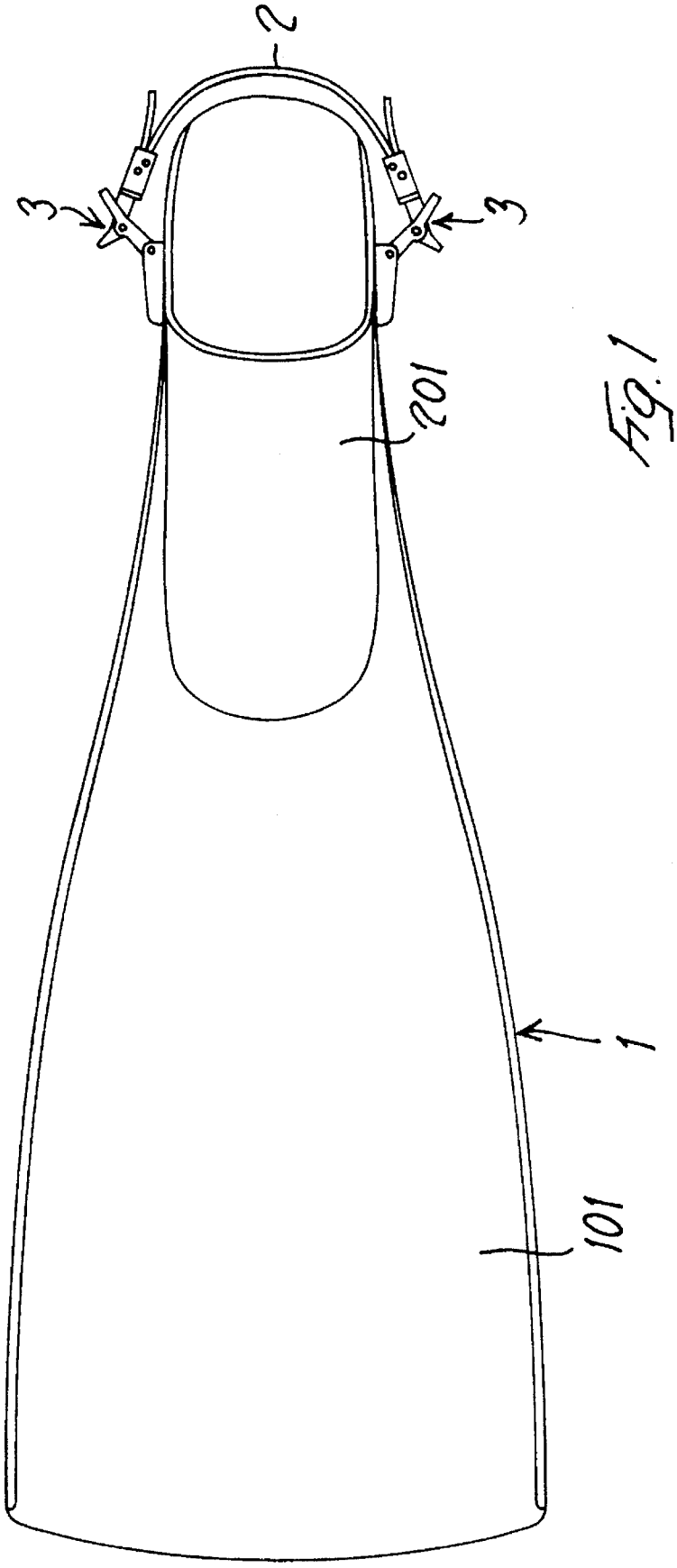
FIG. 1 is a plan view of a fin with a buckle according to the invention.

With reference to the drawings, and with particular reference to FIG. 1, the numeral 1 indicates a swimming fin of the type comprising, as is entirely usual, a blade portion 101 and a socket or shoe 201 in which the user's foot is placed, this socket 201 being open at the heel end. The fin has a heel strap 2 for retaining the user's foot. The two ends of the strap 2 are each secured to a buckle 3 according to the invention, said buckles being connected in turn in such a way as to be able to pivot about pins 211 formed integrally with, and projecting laterally from, the sides of the socket 201, as will be explained further below.

Figure 2:
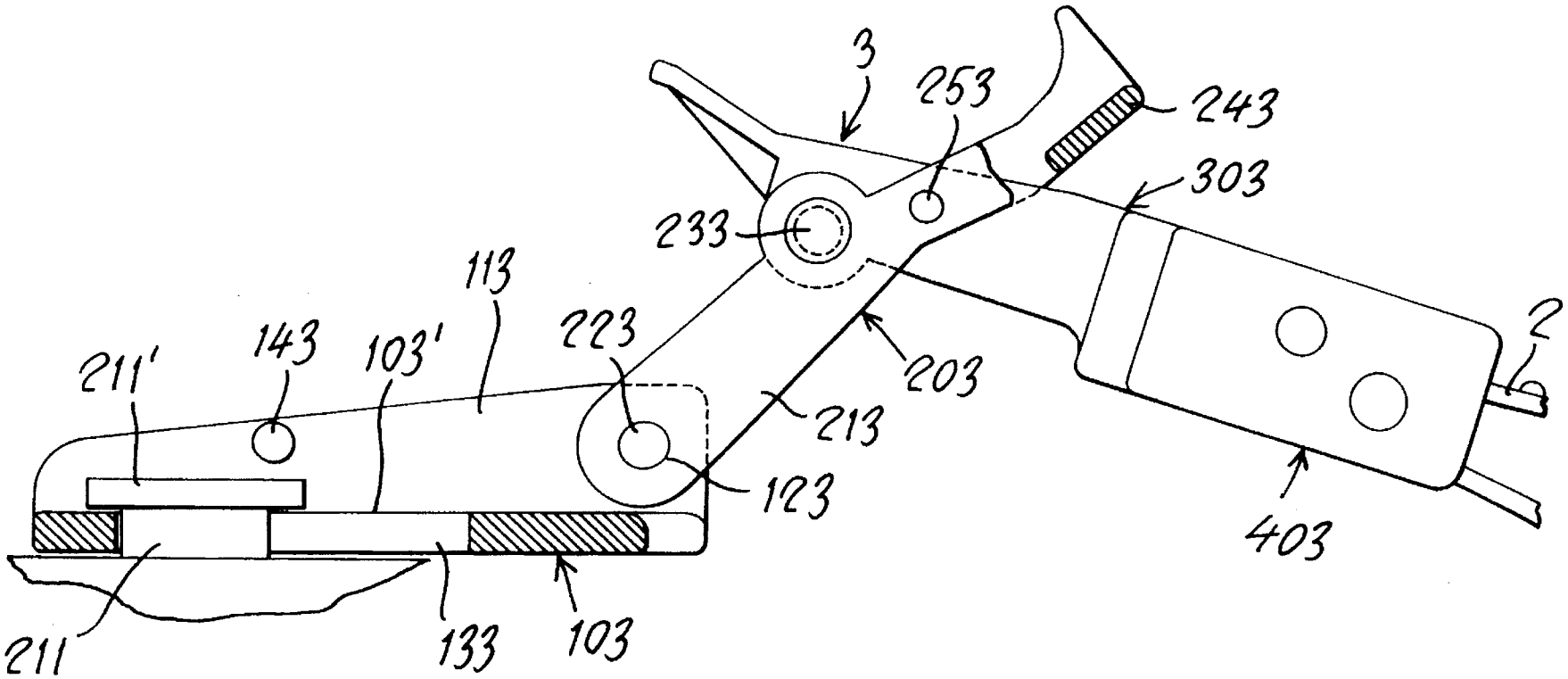
FIG. 2 is a view in lateral elevation on an enlarged scale, with parts in section, of the buckle of the fin illustrated in FIG. 1.
Figure 4:
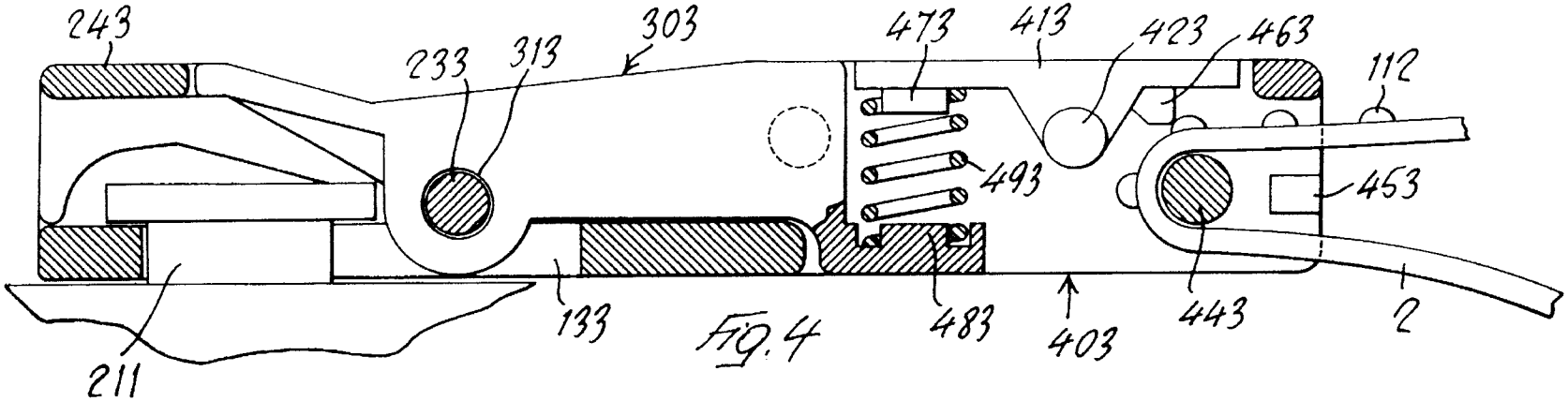
FIG. 4 is a view taken in section through the line IV—IV of FIG. 3.
Figure 3:
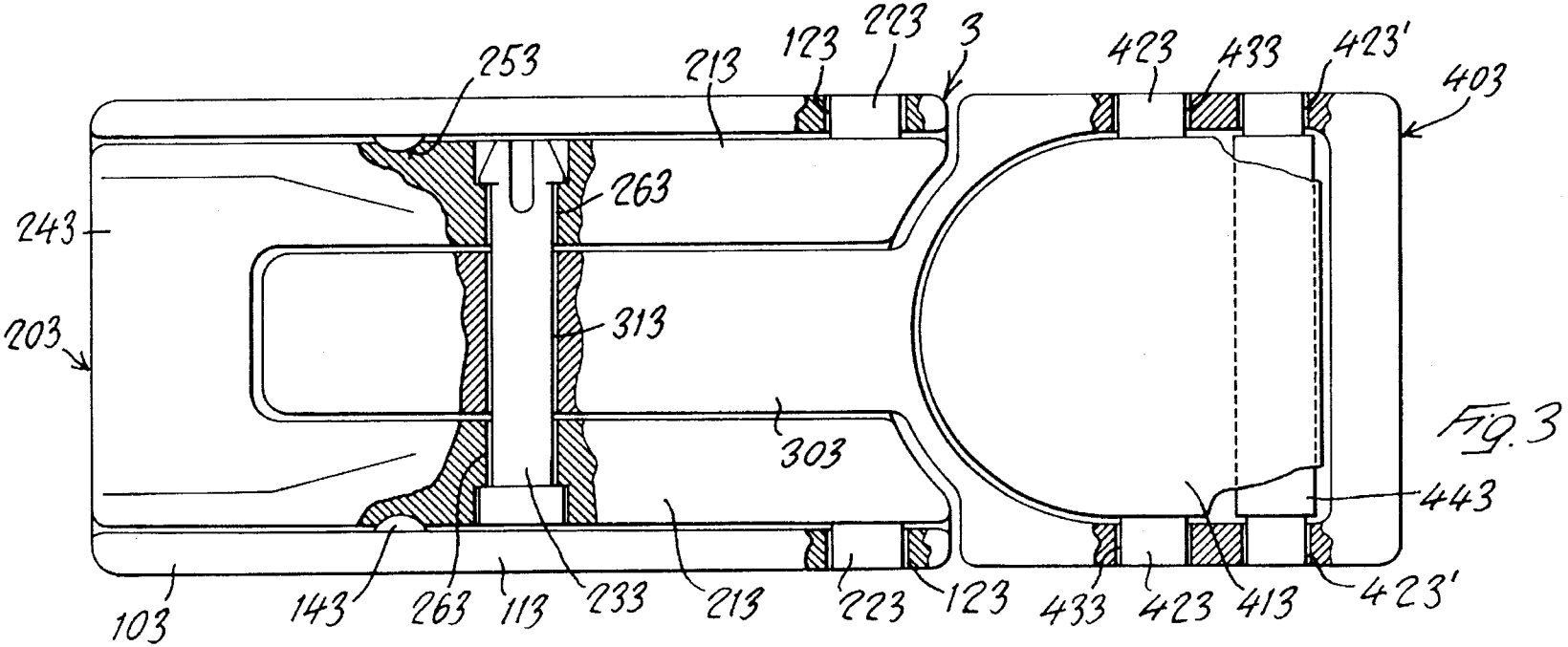
FIG. 3 is a plan view with parts in section of the buckle illustrated in FIG. 2.

With particular reference to FIGS. 2, 3 and 4, a buckle 3 will now be described.

This buckle comprises three parts hinged to each other, namely: a base piece 103, an intermediate lever 203 and an end piece 303 for connection to the end of the strap 2.

The base piece 103 is basically U-shaped in cross section and comprises a wall piece 103' and two lateral flanges 113. In the wall piece 103' is a slot 133, at one end of which is a passage of greater diameter to allow the head 211' of the pins 211 to pass through it, while at the other end, near one end of the piece 103', this passage narrows down to the diameter of the pins 211 themselves.

At the opposite end of the piece 103, the two lateral flanges 113 are provided with two through holes 123 in axial alignment with each other, in which pivot pins 223 carried by the intermediate piece 203 engage. The intermediate piece 203 takes the form of a fork-shaped piece comprising two arms 213 connected together at one end by a crosspiece 243. The free ends of the arms 213 carry the pins 223 that enable it to pivot on the base piece 103. In the middle of these arms are two through holes 263 in axial alignment for the passage of a pin 233 on which the end piece 303 pivots, as will be described below. In a position on the arms 213 between the intermediate hinge point and their free ends is a lateral recess 253 which, when the buckle is closed, engages in a snap action with the projection 143 formed on the flanges 113 of the piece 103.

The end piece 303 is approximately T-shaped, the leg of the T having a through hole 313 through which, during assembly, the central part of the pin 233 is passed. Attached to the head of the piece 303 is the piece 403 for retaining and adjusting the heel strap 2. This piece comprises, in a manner known per se, a parallelepipedal box body 403 whose underside is open and whose topside comprises a pivoting cover 413 connected to the side walls of the body 403 by two pins 423 inserted in holes 433 in said walls. Said cover comprises a cylindrical stud 473 on the inner face of its rear end which engages with one end of a helical spring 493, the opposite end of which is held in a similar stud 483 projecting from the bottom of said box body 403. Towards its front end, the cover 413 has a raised bar 463 on the face turned towards the interior of the body 403, and this cooperates with a roller 443 held in the holes 423' in the side walls of the body 403 through which the strap 2 is guided.

The operation of the buckle described above will be clear from the following. With the buckle 3 in the open position, that is in the position shown in FIG. 2, the user places his foot in the socket 201 of the fin 1. At this point the buckle 3 is closed: the lever 203 is pushed towards the base 103 by applying pressure on the free end 243 of said lever. The arm 303 connected to it by the pin 233 inserted through the holes 263 in the prongs 213 of the lever and through the hole 313 in said arm 303, is pulled towards the base 103. Complete closure is effected when the teeth 143 on the flanges 113 are inserted in the recesses 253 of the prongs 213. Conversely, by pushing the free end 243 of the lever up and disengaging the teeth 143 from the recesses 253, the buckle 3 is opened.

Once the buckle has been closed, the length of the strap 2 can be adjusted in a known manner by means of the connection means 403.

It will also be obvious that the fin cannot slip from the diver's foot even if the buckle 3 is opened because the strap 2 still passes around the heel. Clearly, the fact that opening the buckle does not involve completely disengaging the strap from one side of the socket means that the fin can be carried with greater ease.

The effort required to close and open said buckle 3 is very small and at any rate requires the use of only one hand, unlike known devices. Furthermore, the ease with which the free end 243 of the lever 203 can be gripped in order to open or close the buckle 3 makes it possible to do so even if the user is wearing diving gloves, which are usually fairly thick and therefore restrict a person's movements.

I claim:

1. A swim fin comprising: an open-shoe type fin with a socket for the foot of a user, and provided with a heel strap for securing the fin to the heel of the foot of the user and further comprising at least one buckle for securing said heel strap to the open-shoe type fin, in which said buckle comprises a generally flat base piece, said base piece comprising a wall piece and two lateral flanges perpendicular thereto; means for securing said base piece on the side of the fin next to the socket for the foot; an intermediate lever hinged at one end in said base piece; and an end piece bearing at one end a means for connection to said strap, while its other end is hinged at a point on said intermediate lever between the end hinged to the base piece and the free end.

2. A swim fin as claimed in claim 1, wherein said means for the connection of said strap also allow for its length to be adjusted.

3. A swim fin as claimed in claim 2, wherein said intermediate lever is essentially fork-shaped, and the arms of the intermediate lever point towards the base piece and are connected to it, said end piece being inserted in the loop formed between said arms of said intermediate lever.

4. A swim fin as claimed in claim 1, wherein said base piece is provided on the inner surface of its lateral flanges with projections, and the outer surface of said intermediate lever is provided with recesses complimentary to said projection so as to provide, in the closed position of the buckle, for the snap closure of the buckle.

5. A swim fin as claimed in claim 1, wherein said base piece is provided on the inner surface of its lateral flanges with recesses, and the outer surface of said intermediate lever is provided with projections complementary to said recesses so as to provide, in the closed position of the buckle, for the snap closure of the buckle.

6. A swim fin according to claim 1, wherein said means for securing said base piece to said fin comprises a slot in said wall piece of the base piece, said slot having a passage of greater diameter at the end of the base piece at which the lever is hinged, and a passage of reduced diameter toward its other end, and a pin projecting from the sides of said fin, said pin being formed with head of a diameter corresponding to the diameter of the passage of greater diameter of the slot, and with a shank having a diameter corresponding to the reduced diameter of the slot.

7. A swim fin comprising:

an open-shoe type fin with a socket for the foot of a user, a heel strap for securing said fin to said heel of the foot of a user, at least one buckle for securing said heel strap to said open-shoe type fin in which said buckle comprises:

a generally flat base piece;

means for securing said base piece on the side of said fin next to said socket;

an intermediate fork-shaped lever having a loop-shaped portion provided between two fork arms at one end, said lever being hinged at the other end of said loop-shaped portion to said base piece; and an end piece hinged at one end to said loop-shaped portion of said intermediate lever, said end piece having a connecting means at the other end for connecting said end piece to said strap.

8. A swim fin as claimed in claim 7, wherein said base piece is provided on the inner surface of its lateral flanges with projections, and the outer surface of said intermediate lever is provided with recesses complimentary to said projection so as to provide, in the closed position of the buckle, for the snap closure of the buckle.

9. A swim fin as claimed in claim 7, wherein said base piece is provided on the inner surface of its lateral flanges with recesses, and the outer surface of said intermediate lever is provided with projections complementary to said recesses so as to provide, in the closed position of the buckle, for the snap closure of the buckle.

* * * * *